US011369832B2

(12) United States Patent
Thomas

(10) Patent No.: US 11,369,832 B2
(45) Date of Patent: Jun. 28, 2022

(54) FITNESS HARNESS

(71) Applicant: Andrew B Thomas, Tampa, FL (US)

(72) Inventor: Andrew B Thomas, Tampa, FL (US)

( * ) Notice: Subject to any disclaimer, the term of this patent is extended or adjusted under 35 U.S.C. 154(b) by 95 days.

(21) Appl. No.: 16/926,979

(22) Filed: Jul. 13, 2020

(65) Prior Publication Data

US 2021/0361998 A1 Nov. 25, 2021

Related U.S. Application Data

(60) Provisional application No. 63/028,913, filed on May 22, 2020.

(51) Int. Cl.
*A63B 21/00* (2006.01)
*A63B 21/04* (2006.01)
*A63B 23/02* (2006.01)

(52) U.S. Cl.
CPC ..... *A63B 21/4011* (2015.10); *A63B 21/04* (2013.01); *A63B 23/0211* (2013.01); *A63B 2208/0233* (2013.01)

(58) Field of Classification Search
CPC ..... A63B 21/00181; A63B 21/04; A63B 21/4011; A63B 23/0211; A63B 2208/0233
See application file for complete search history.

(56) References Cited

U.S. PATENT DOCUMENTS 936,006 A * 10/1909 Matzner ..... A62B 35/04 182/4
3,540,439 A * 11/1970 Gaylord, Jr. ..... A61H 1/0218 602/36
4,984,786 A * 1/1991 Lemke ..... A63B 21/4001 482/139
5,122,107 A * 6/1992 Gardner ..... A63B 23/0211 482/140
5,158,510 A * 10/1992 Lemire ..... A63B 21/4001 52/74
6,490,733 B1 * 12/2002 Casaubon ..... A41D 13/0007 2/81
7,104,932 B1 * 9/2006 Brentlinger ..... A63B 69/12 434/254
7,585,263 B2 9/2009 Brown et al.
7,611,445 B2 11/2009 Brown et al.
8,029,425 B2 10/2011 Bronston et al.
8,870,726 B2 10/2014 Watterson
9,101,789 B2 * 8/2015 Schierenbeck .... A62B 35/0031
9,630,044 B2 * 4/2017 Nelson ..... A63B 21/00061
9,901,775 B2 * 2/2018 Sykes ..... A63B 21/4003
(Continued)

*Primary Examiner* — Joshua Lee
(74) *Attorney, Agent, or Firm* — Pablo Meles

(57) ABSTRACT

A harness belt system for assisting in the performance of exercises includes at least one belt member, an adjustable belt clip on at least one of two opposing ends of the belt member, and a substantially V-shaped tether having at least a top portion coupled to the belt member and a bottom end. In some embodiments, the top end of the substantially V-shaped tether couples to the belt member and forms at least an angle with the belt member ranging from 91 degrees to 158 degrees. In some embodiments, the system is configured when in use to have the bottom end of the tether tethered to a stationary object and to have the belt member in a closed position for placement of the adjustable belt clip and belt on bent legs over a front of a user's thigh or behind the user's thigh or on a user's calves.

20 Claims, 11 Drawing Sheets

(56) References Cited

U.S. PATENT DOCUMENTS

| | | | | |
|---|---|---|---|---|
| 10,293,200 | B1 * | 5/2019 | Jaynes | A41D 13/0007 |
| 10,300,326 | B2 * | 5/2019 | Warren | A63B 21/16 |
| 2005/0045420 | A1 * | 3/2005 | Diggle | A62B 35/0025 182/9 |
| 2014/0256519 | A1 * | 9/2014 | Nelson | A63B 21/065 482/105 |
| 2016/0310811 | A1 * | 10/2016 | Bledsoe | A63B 69/0059 |
| 2018/0193686 | A1 * | 7/2018 | Adeeko, Jr. | A63B 21/4011 |
| 2019/0038928 | A1 * | 2/2019 | Roberts | A63B 21/0442 |

* cited by examiner

10

10

30

40

50

60

70

70A

70B

80

90

200

FITNESS HARNESS

CROSS-REFERENCE TO RELATED APPLICATIONS

This application claims priority from U.S. Provisional Application No. 63/028,913, filed May 22, 2020, the entire contents of which is incorporated herein by reference

BACKGROUND

The present disclosure is directed to an apparatus and system for aiding in the performance of sit-ups or other abdominal exercises.

DESCRIPTION OF THE RELATED ART

Current methods to address some of the issues resolved by the current embodiments use devices that attach around a user's feet, require the use of one's hand, create poor posture or form, and/or cut-off a user's circulation. Some existing devices may require the assistance of a third party.

DETAILED DESCRIPTION

Figure 1:
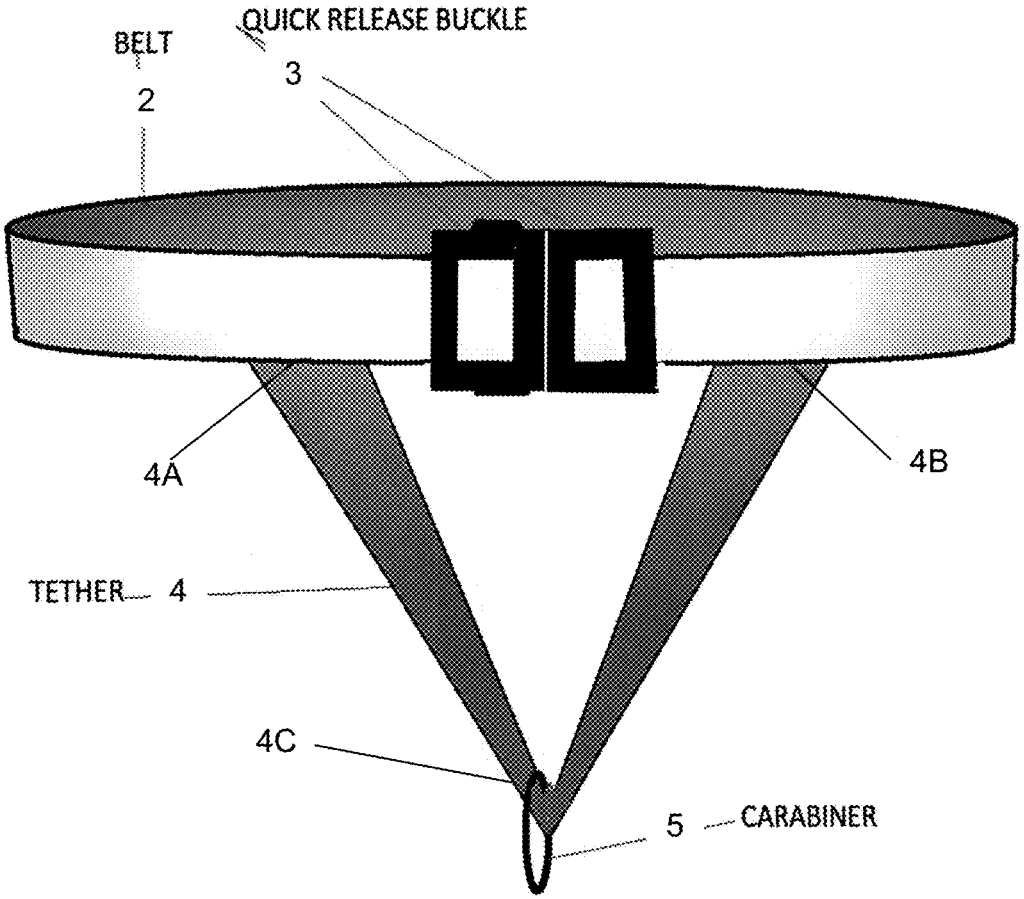
FIG. 1 illustrates a front view of a harness or system in a closed position for abdominal strength training in accordance with the embodiments.

In some embodiments, a system or apparatus for a sit-up harness can include a lightweight portable exercise apparatus for abdominal strength training. The portable exercise apparatus can include an adjustable harness with a quick release buckle that is placed over bent legs (either in front of the thighs or behind the thighs on the calves) when laying down and tethered to a stationary object. The tether is attached to the harness in one of several ways. The apparatus will allow the user to perform sit-ups independently where the user can do sit-ups without the assistance of a third party when wearing the apparatus. The user requires no assistance to keep the legs in place to perform sit-ups when wearing the apparatus.

In some embodiments the portable harness can assist a person in doing full sit-ups independently in any location where you can tether to a stationary object and can come in the form of a single adjustable belt/strap made of sturdy flexible material that is not elastic that is attached to a tether belt or strap. The adjustable belt/strap can be of sufficient length to be wrapped around both thighs of person at the mid point of their thighs and the tether belt/strap coming out from under/over the thigh belt/strap can have a carabiner hook at the end that will attach to a stationary object either directly from the harness or with the extension for objects that are larger in size or objects that the carabiner will not be able to attach to.

In some embodiments, the portable exercise device can have a belt and tether made of a single or unitary piece. In yet some other embodiments, the portable exercise device can alternatively include leg straps formed of two separate pieces (replacing the single belt/strap of other embodiments) where each leg strap is coupled to (two) ends of a triangular tether and where each leg strap can have hook and loop fastener means (such as Velcro™) that overlap each leg strap or alternatively each have belt clips or cinching clips that allow placement and fastening of each leg strap to each leg. A third end of the triangular tether can couple to a fixed object to confine the leg straps laterally relative to the fixed object while allowing movement of the leg strap relative to the fixed object.

In some embodiments, the portable exercise device includes a tether substantially in the shape of a "V" attached or integrated with the belt. The tether can be attached or be constructed to be at an angle ranging from 22 degrees to 89 degrees from the belt. In some embodiments, the tether can be sewed on to the belt, looped over the belt, hooked onto the belt, riveted to the belt, braided into the belt, or glued on to the belt. In some embodiments, the tether can be attached to the belt using rings.

The belt and/or tether can be made of plastic, vinyl, metal links, leather, or all types of webbing or cloth. Ideally, the material used does not have too much elasticity to defeat the purpose of assisting sit-ups. The tether and/or belt can be of any length, but in some embodiments the tether can be about 12 inches in length when attached to the belt. In some embodiments, the belt can be approximately 2 inches wide. The belt is ideally a one-size-fits all arrangement that can be adjustable at a quick release buckle at the end or ends of the belt. In some embodiments, the portable exercise device can include an extension for the tether made from the same material as the belt.

Figure 9:
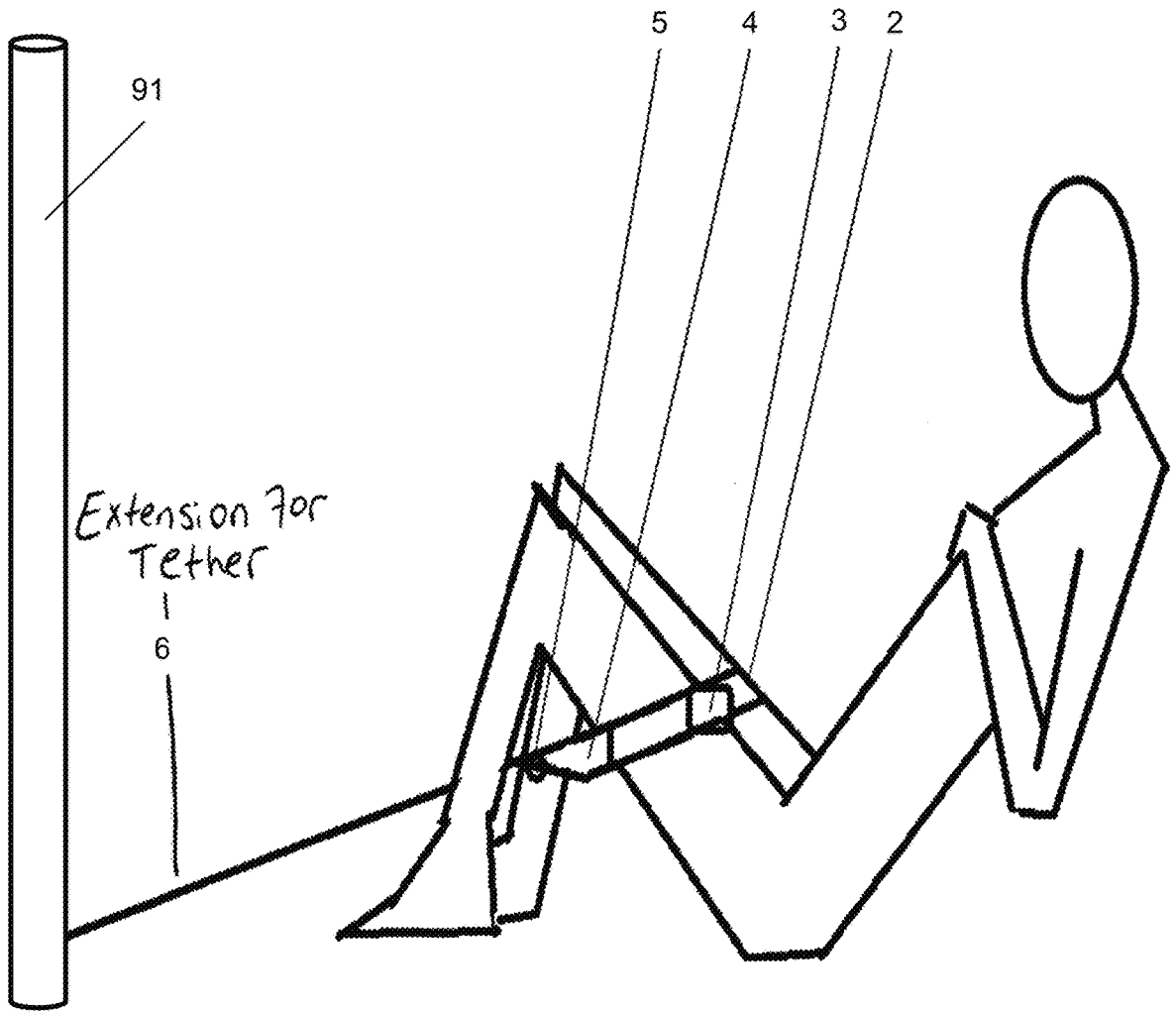
FIG. 9 illustrates the use of one of the systems from FIGS. 1-8 in accordance with the embodiments.

Referring to FIG. 1, a harness belt system 10 for assisting in the performance of exercises such as sit-ups can include a belt member 2, an adjustable belt clip 3 on at least one of two opposing ends of the belt member 2, and a substantially V-shaped tether 4 having at least two top ends (4A and 4B) coupled to separate portions of the belt member 2 and a bottom end 4C. In some embodiments, the harness belt system 10 can be configured when in use to have the bottom end 4C of the substantially V-shaped tether 4 tethered to a stationary object (such as pole 91 in FIG. 9) and to have the belt member 4 in a closed position for placement of the adjustable belt clip 3 and belt 4 on bent legs over a front of a user's thigh (as shown in FIG. 9) or behind the user's thigh or on a user's calves. In some embodiments, the system 10 further comprises a caribiner 5 attached at the bottom end 4C of the substantially V-shaped tether 4.

Figure 2:
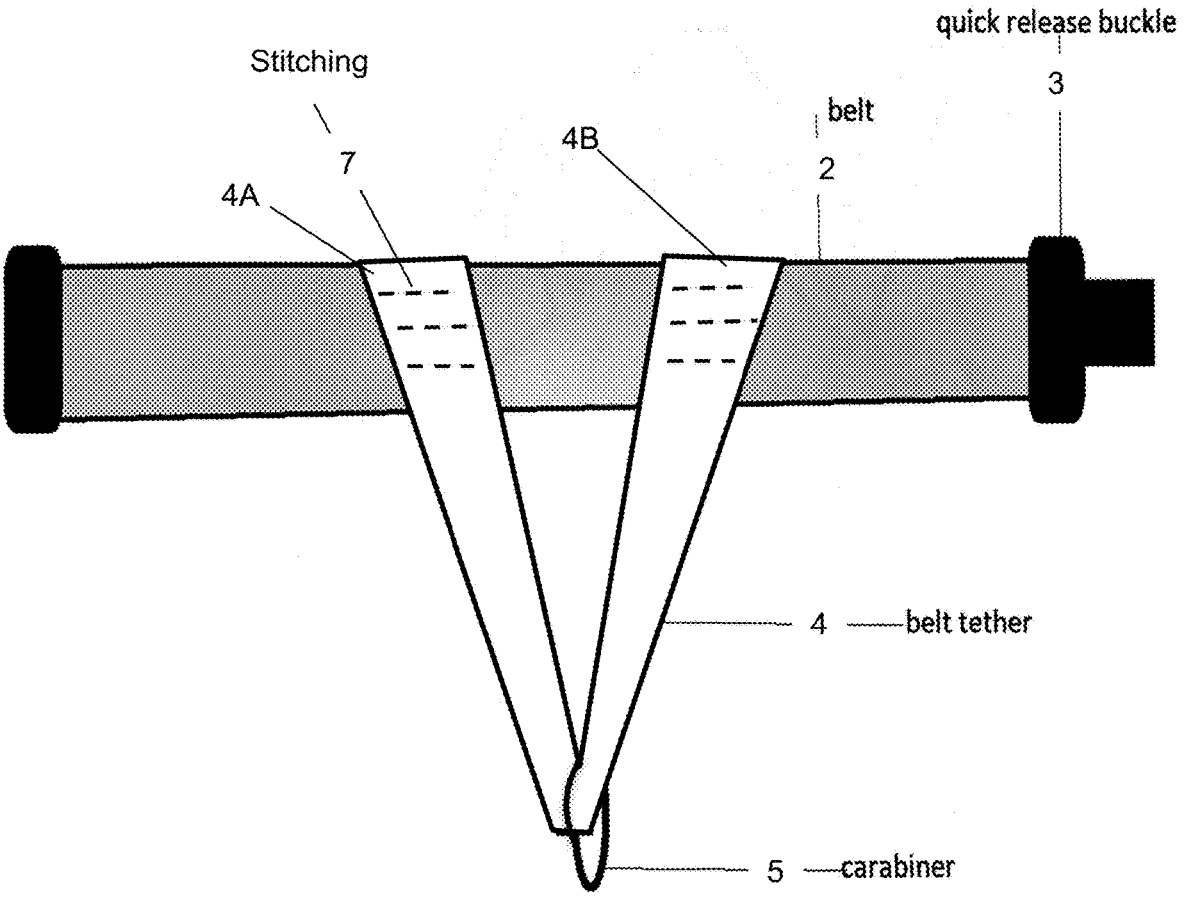
FIG. 2 illustrates a front view of the harness or system of FIG. 1 in an open position in accordance with the embodiments.
Figure 3:
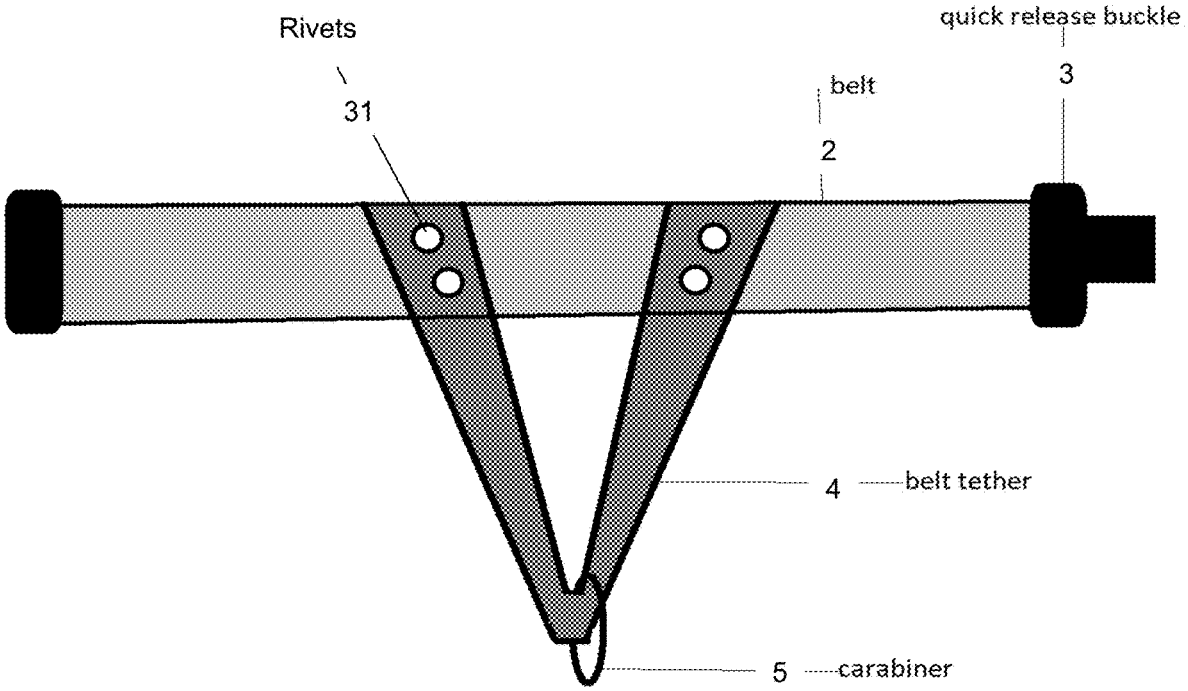
FIG. 3 illustrates yet another harness or system in an open position in accordance with the embodiments

In some embodiments, the adjustable belt clip 3 is a quick release buckle. In some embodiments, the substantially V-shaped tether 4 is coupled to the belt member by sewing or stitching the top ends 4A and 4B of the tether 4 with stitching 7 to separate portions of the belt member 2 as shown in FIG. 2. In some embodiments as shown in the system 30 of FIG. 3, the substantially V-shaped tether 4 is coupled to the belt member 2 by riveting the top ends of the tether 4 with rivets 31 to separate portions of the belt member. At least one rivet should be used, but two or more can also be used per side of the V-shaped tether 4.

Figure 4:
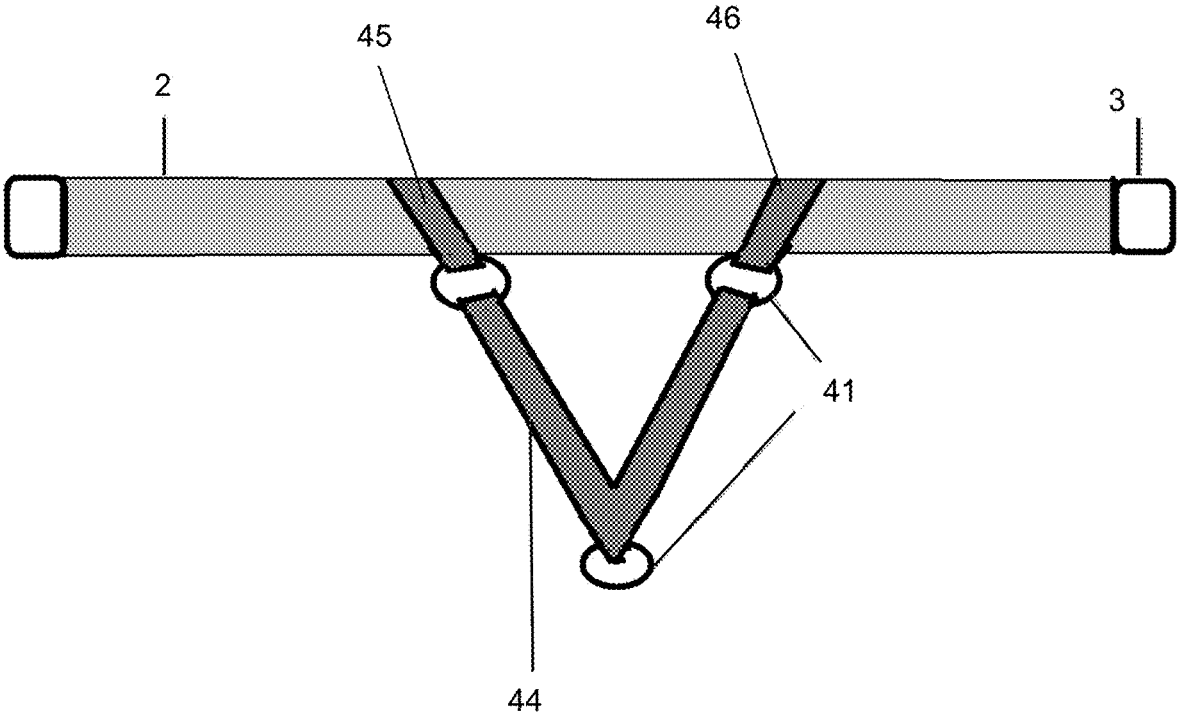
FIG. 4 illustrates a front view of another harness or system in an open position that uses rings in accordance with the embodiments.

Referring to the harness belt system 40 of FIG. 4, in some embodiments the substantially V-shaped tether 44 is coupled to the belt member 2 by using rings 41. In some embodiments, the rings 41 could hook directly into the belt member 2 (not shown). In other embodiments the substantially V-shaped tether 4 can be coupled to the belt member 2 by looping the top ends of the tether 4 directly onto separate portions of the belt member (not shown) or by hooking the top ends of the tether onto separate portions of the belt member via the rings 41 as shown in FIG. 4. In yet other embodiments, the tether 4 can be coupled to the belt member 2 by braiding the top ends of the tether 4 into separate portions of the belt member 2.

Figure 5:
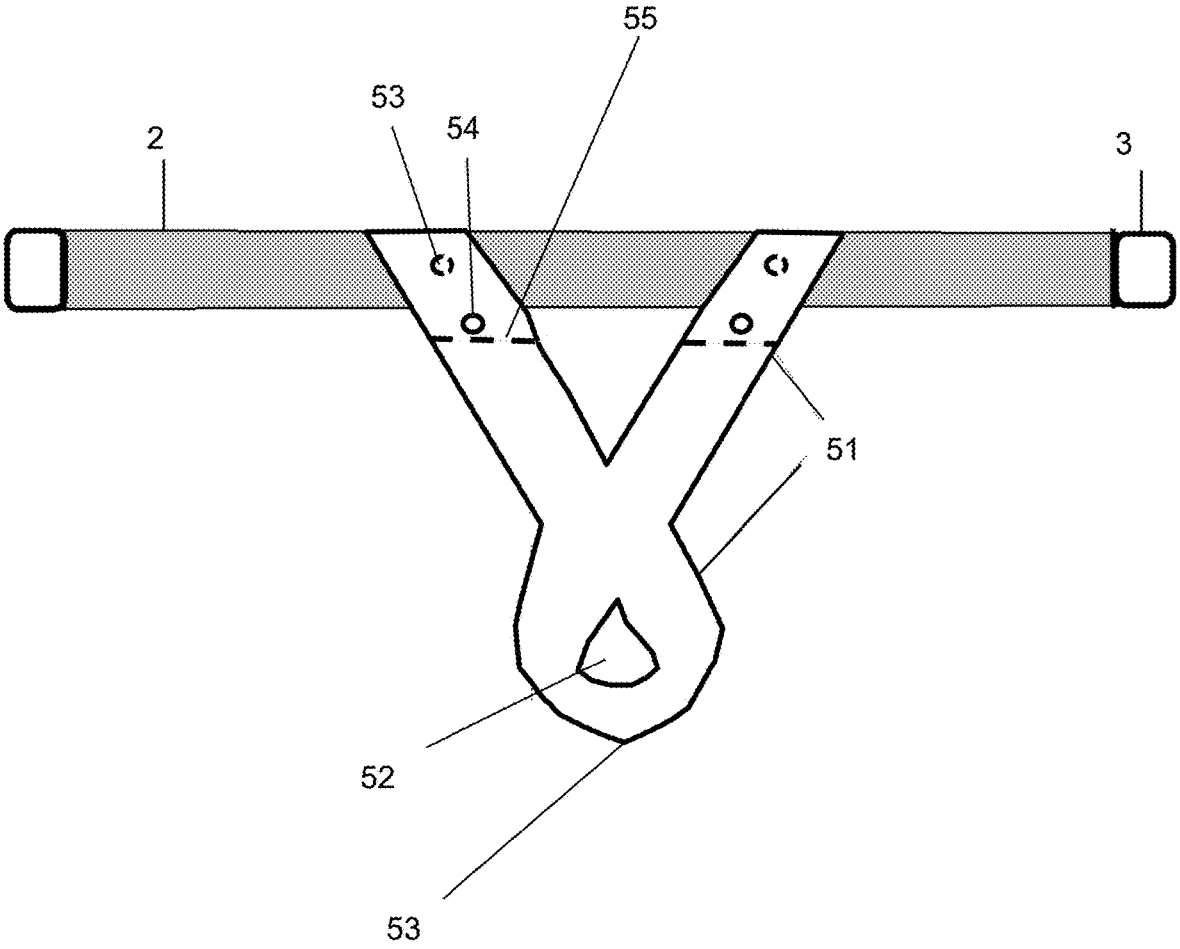
FIG. 5 illustrates a front view of another harness or system in an open position that uses rivets to attach or loop the tether to the belt in accordance with the embodiments.

Referring to the harness belt system 50 of FIG. 5, in some embodiments the system 50 can include a belt member 2 and a substantially V-shaped tether 51 in the form of a single strap that is looped at a mid-point 53 of the single strap (51) to form a loop 52 at the bottom end of the V-shaped tether 51. The tether 51 can be coupled to the belt member 2 in any number of ways including at least one rivet 53 that rivets the tether 51 to the belt member 2. If the ends of the single strap are looped around the belt, the ends can be closed around the belt using either another rivet 54 or stitching 55. In some embodiments, the ends can be closed around the belt using both riveting and stitching. In some embodiments generally, the substantially v-shaped tether can be coupled to the belt member 2 by using adhesive between each of the top ends of the tether and the separate portions of the belt member that would mate with the top ends of the tether.

Figure 6:
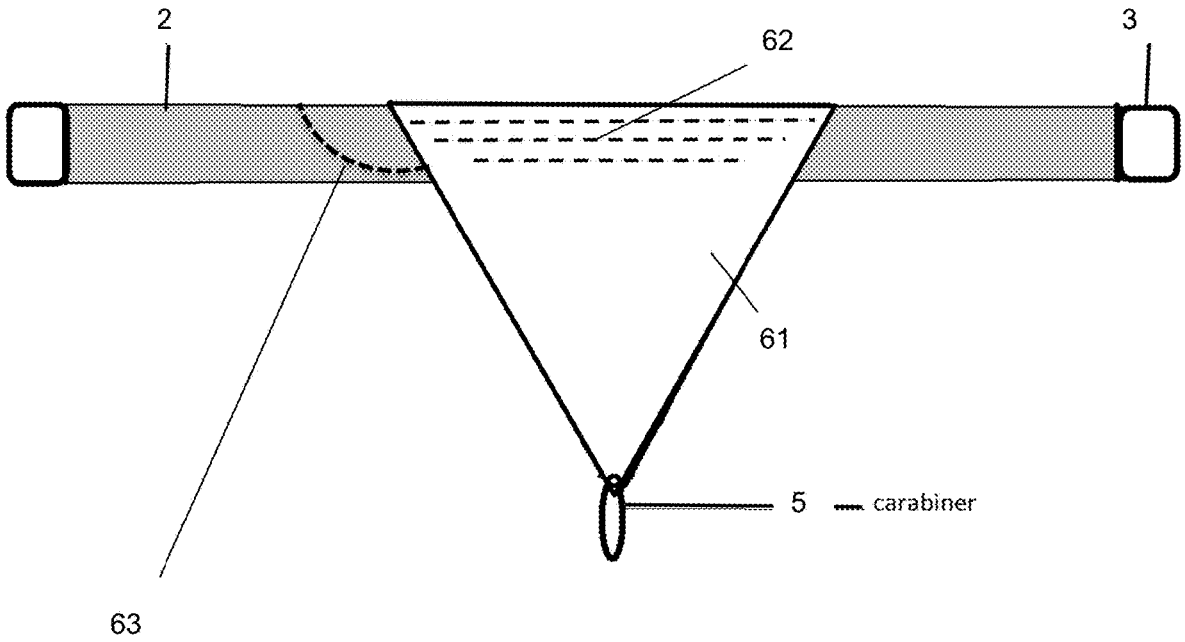
FIG. 6 illustrates another harness or system in an open position in accordance with the embodiments.

In some embodiments, the belt member 2 and tether are separate members as shown in FIGS. 1-5 as well as in the system 60 of FIG. 6. In the embodiment of FIG. 6, the system 60 can include a belt member 2 and a tether 61 in the form of an inverted triangle (which is considered a subset of a substantially V-shaped tether) that is coupled to the belt member 2 via stitching 62 as shown. In some embodiments, the top end of the substantially V-shaped tether couples to the belt member 2 and forms at least an angle 63 with the belt member 2 ranging from 91 degrees to 158 degrees. In the case of the use of an equilateral triangle (where the angles inside the triangle are each 60 degrees) for the tether 61, the angle 63 is then 120 degrees.

Figure 7:
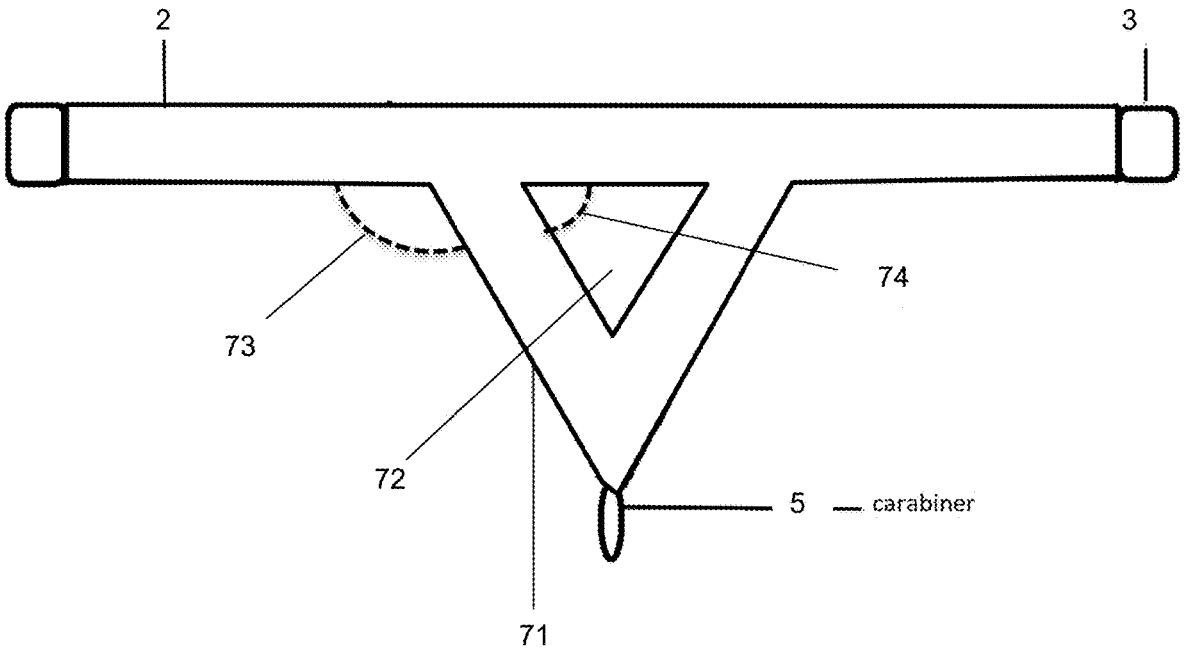
FIG. 7 illustrates another harness or system having an integrated belt and tether in an open position in accordance with the embodiments.
Figure 8:
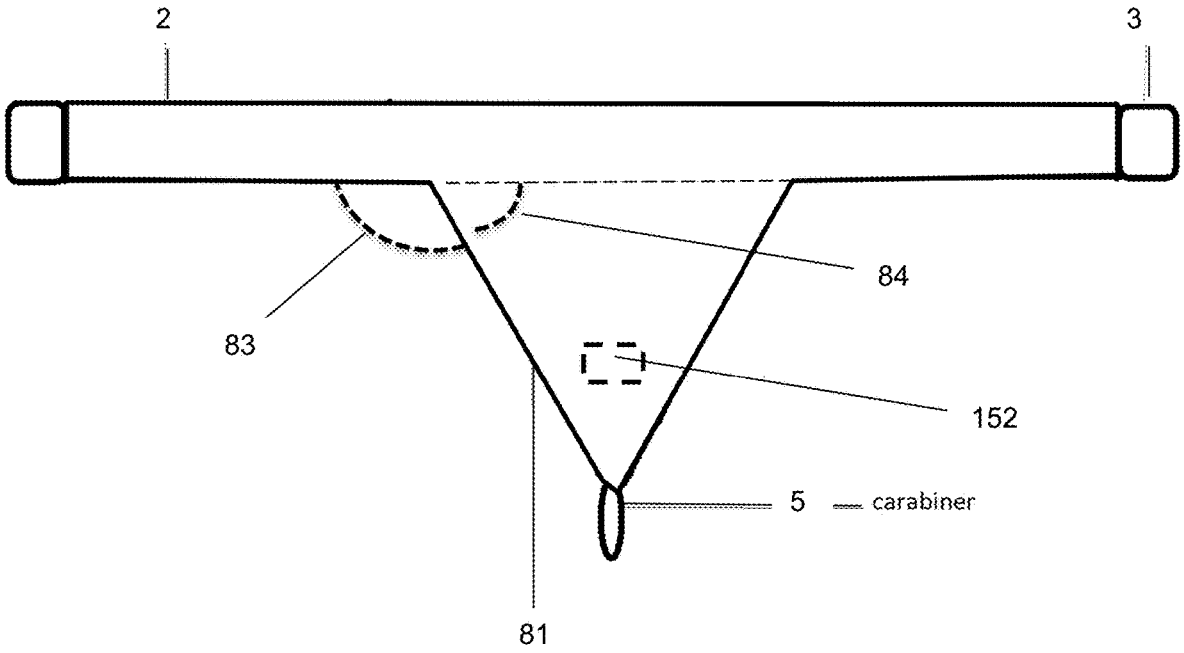
FIG. 8 illustrates another harness or system having another integrated belt and tether in an open position in accordance with the embodiments.

In some embodiments, the system 70 or 80 as shown in FIG. 7 or 8 respectively can include a belt member 2 and a substantially V-shaped tether (71 or 81) that are integrated and formed from a single piece of material. The material can be a single stamped out or formed piece of material. In FIG. 7, the material can be stamped out or otherwise formed to create a substantially V-shaped tether 71 that has a cut-out triangular shape 72 to form the "V" shape. In FIG. 8, the "V" shape is formed out of an inverted triangle that is integrated with the belt member 2. Again, in some embodiments, the top end of the substantially V-shaped tether couples (or is integrated as in the cases of FIGS. 7 and 8) to the belt member 2 and forms at least an angle 73 or 83 with the belt member 2 ranging from 91 degrees to 158 degrees. From a complementary perspective, each of the top ends of the substantially V-shaped tether couples to the belt member at an angle 74 or 84 ranging from 22 degrees to 89 degrees. Again, in the case of the use of an equilateral triangle (where the angles inside the triangle are each 60 degrees) for the tether, the angle 73 or 83 is then 120 degrees and the angle 74 or 84 is 60 degrees. In another example, if the angle 74 or 84 is 45 degrees, then the angle 73 or 83 is 135 degrees.

Figure 7A:
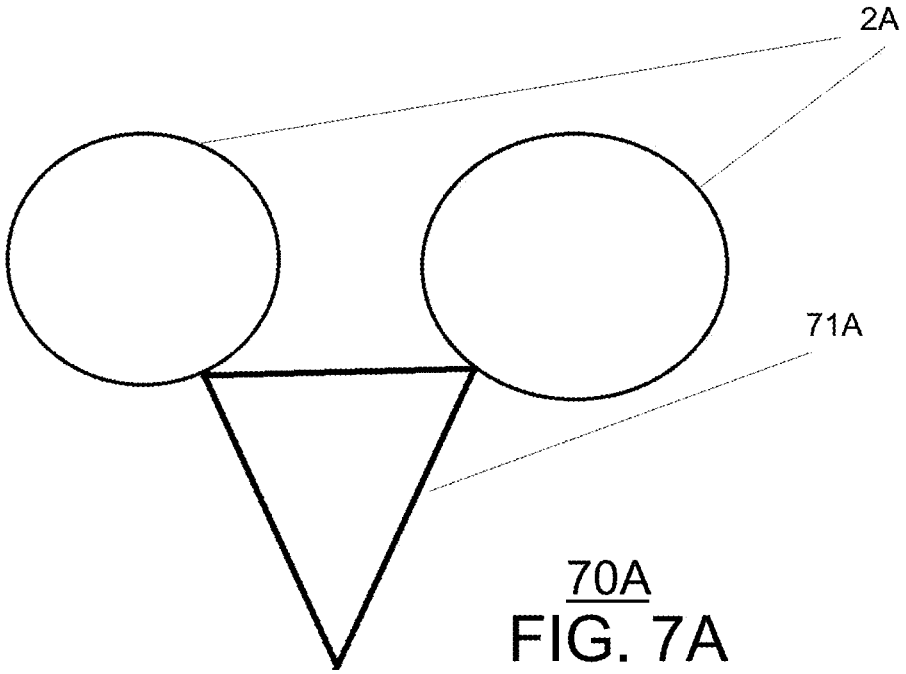
FIGS. 7A and 7B illustrate yet other harnesses or systems having belt or belts and a tether in closed positions in accordance with the embodiments.
Figure 7B:
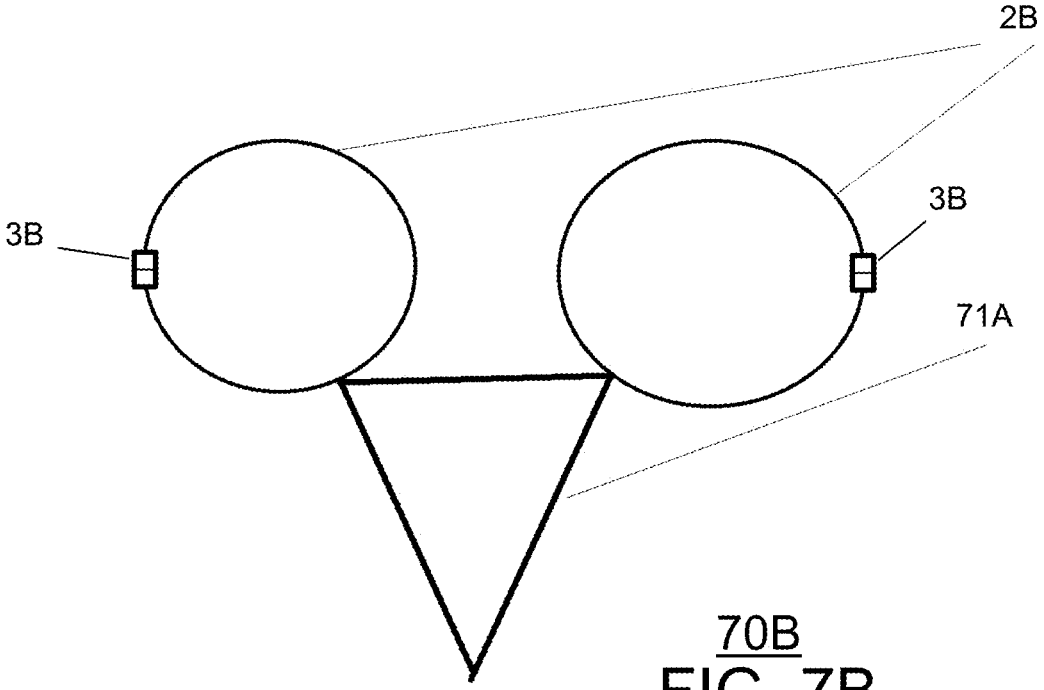

In a different variant of system 70 or 80, FIG. 7A illustrates a system 70A that includes two belt members 2A coupled to two separate ends of a v-shaped tether 71A. The belt members 2A can each be fixed closed loop that can be slipped over each leg. In one mode of operation, the user can slip the belt members 2A over the user's thighs and couple the tether 71A to a fixed object before performing abdominal exercises. In another mode of operation, the user can slip the belt members 2A over the users calves and couple the tether 71A to the fixed object before performing abdominal exercises. The system 70B of FIG. 7B is yet another slight variant that replaces the fixed closed loop of belt members 2A with belt members 2B that further include clips or adjustable fastener members 3B. The fastener members 3B allow the user to wrap the individual belt members 2B around each leg (thigh or calf). The fastener members 3B can be regular clips, or cinchable clips or Velcro™ or other types of fasteners.

Referring to FIGS. 7 and 8, both embodiments include an integrated belt member and tether that can be made of a single material or a composite of materials. For example, the belt and tether can be made of materials selected from plastic, vinyl, metal, leather, webbing, cloth, or any combination thereof. Further note in other embodiments where the belt member and tether are not integrated, each of the belt member or tether can be made of materials selected from plastic, vinyl, metal, leather, webbing, cloth, or any combination thereof.

In some embodiments as shown in FIG. 8, the system 80 can further include a sensor 152 embedded in the belt member 2 or tether 81 where the sensor 152 detects instances of a motion characteristic of a sit-up (or other exercise pattern) and transmits information regarding the instances to a wireless receiving device such as a phone or fitness watch.

Referring to FIG. 9, a harness belt system 90 can further include an extension 6 to the tether 4 which can be made from the same material as the belt member 2. As in other embodiments, the system 90 can include an adjustable belt clip 3 on at least one of two opposing ends of the belt member 2 and a substantially V-shaped tether 4 having at least a top portion coupled to the belt member and a bottom end. In some embodiments, the substantially V-shaped tether 4 couples to the belt member 2 and forms at least an angle with the belt member 2 ranging from 91 degrees to 158 degrees. As shown in FIG. 9, the system 90 is configured when in use to have the bottom end of the substantially V-shaped tether 4 tethered to a stationary object 91 (either directly or via an a caribiner 5 and/or extension 6) and to have the belt member 2 in a closed position for placement of the adjustable belt clip 3 and belt member 2 on bent legs over a front of a user's thigh or behind the user's thigh or on a user's calves.

In most if not all embodiments, the V-shaped tether 4 couples to (or is integrated with) the belt member 2 and forms at least an angle with the belt member ranging from 91 degrees to 120 degrees. The belt member and/or tether can be made of materials selected from plastic, vinyl, metal, leather, webbing, cloth, or any combination thereof.

Figure 10:
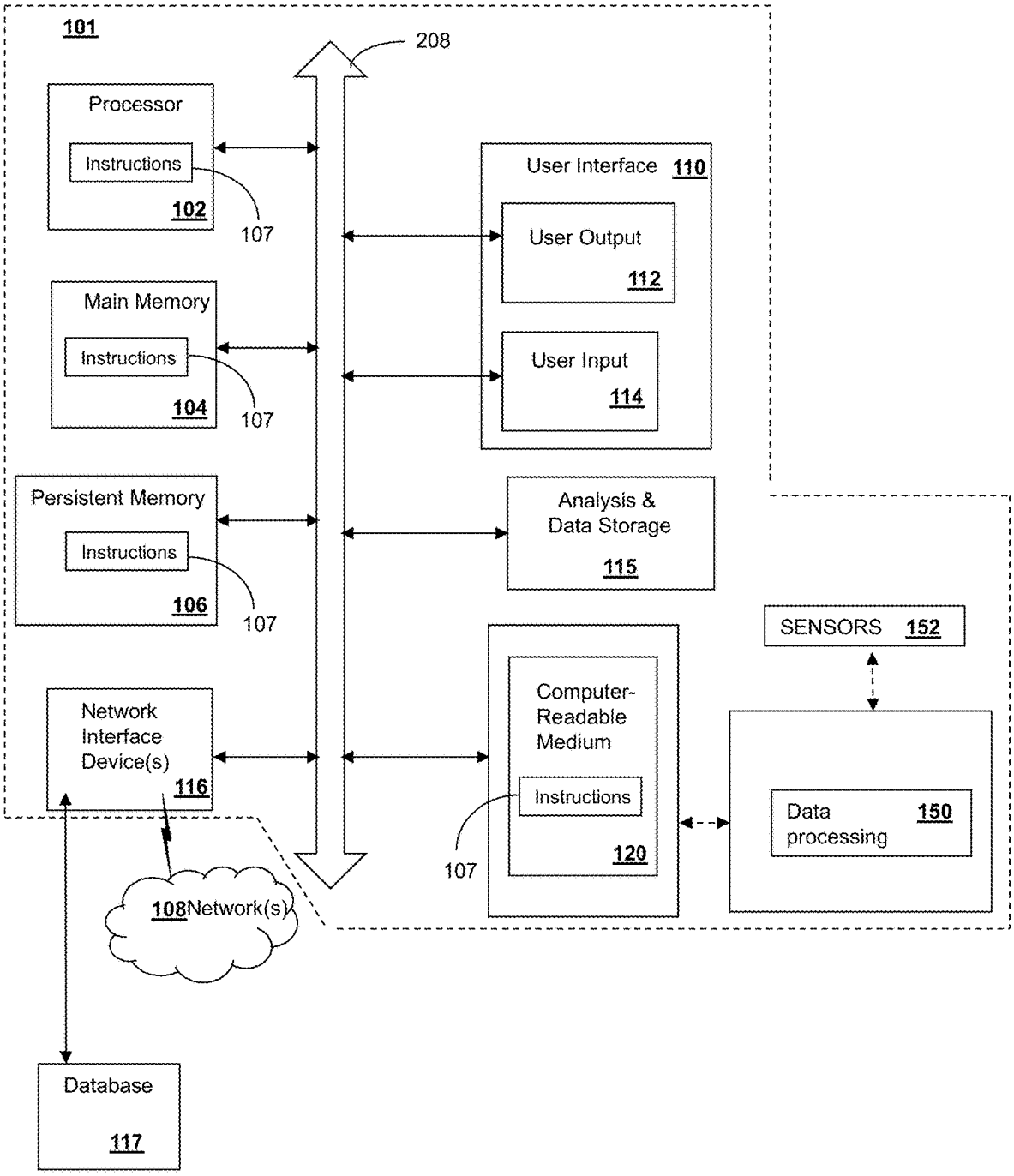
FIG. 10 is a block diagram of a system in accordance with the embodiments.

In some embodiments, and with further references to FIG. 10, a system 200 for an exercise or sit-up harness can include any number and combination of the previously described components above as well as one or more processors which when executing the computer instructions, performs the functions of detecting a count of a repetition of an exercise such as a sit-up.

In some embodiments, the system can utilize artificial intelligence and more particularly machine learning which can use exemplary training data and/or actual commercial use data to further refine what is intended to serve as an exemplary repetition based on a particular environment or a number of known environments. Machine learning is a method of data analysis that automates analytical model building. It is a branch of artificial intelligence based on the idea that systems can learn from data, identify patterns and make decisions with minimal human intervention. Some of the training data that can be used to help identify patterns and make decisions can include fields such as identity codes, scheduling data, location data and/or other parameters obtained from sensors such as cameras, video monitoring devices, audio devices, temperature or other sensor data that can be programmatically configured to more adequately and accurately reflect real world conditions as a system is utilized in a particular environment and hopefully across different environments. Ideally, using machine learning enables systems to automatically learn and improve from experience without being explicitly programmed. Machine learning in the embodiments herein can focus on the development of computer programs (using the Python programming language, for example) to access data and use it to learn for itself in order to better predict when a lockbox should be in either a locked or an unlocked mode.

In some embodiments, the system can be a client device having one or more computer storage mediums containing computer instructions enabling secure access, storage, transport, and tracking of electronically tagged objects, one or more processors operationally coupled to the one or more computer storage mediums where the one or more processors perform the operations described above.

In some embodiments, the system can further include a computer-storage media coupled to a processor (or processors) and computer-executable instructions embodied in the computer-storage media that, when executed by one or more computing devices, perform a method that perform any number of steps such as performing the method of detecting a characteristic indicative of a sit-up repetition, adding a count to each instance of a detection until a timeout signal is detected or until no repetition indicative of a sit-up is detected for a pre-determined period of time.

Various embodiments of the present disclosure can be implemented on an information processing system. The information processing system is capable of implementing and/or performing any of the functionality set forth above. Any suitably configured processing system can be used as the information processing system in embodiments of the present disclosure. The information processing system is operational with numerous other general purpose or special purpose computing system environments, networks, or configurations. Examples of well-known computing systems, environments, and/or configurations that may be suitable for use with the information processing system include, but are not limited to, personal computer systems, server computer systems, thin clients, hand-held or laptop devices, notebook computing devices, multiprocessor systems, mobile devices, microprocessor-based systems, set top boxes, programmable consumer electronics, network PCs, minicomputer systems, mainframe computer systems, Internet-enabled television, and distributed cloud computing environments that include any of the above systems or devices, and the like. As noted previously, the data processing can be any number of data processing techniques suited for tracking repetitions of a particular exercise.

For example, a user with a mobile device may be in communication with a server configured to implement the system using the aforementioned elements, according to an embodiment of the present disclosure. The mobile device can be, for example, a multi-modal wireless communication device, such as a "smart" phone, configured to store and execute mobile device applications ("apps"). Such a wireless communication device communicates with a wireless voice or data network using suitable wireless communications protocols.

The system may include, inter alia, various hardware components such as processing circuitry executing modules that may be described in the general context of computer system-executable instructions, such as program modules, being executed by the system. Generally, program modules can include routines, programs, objects, components, logic, data structures, and so on that perform particular tasks or implement particular abstract data types. The modules may be practiced in various computing environments such as conventional and distributed cloud computing environments where tasks are performed by remote processing devices that are linked through a communications network. In a distributed cloud computing environment, program modules may be located in both local and remote computer system storage media including memory storage devices. Program modules generally carry out the functions and/or methodologies of embodiments of the present disclosure, as described above.

In some embodiments, a system includes at least one memory and at least one or more processor of a computer system communicatively coupled to the at least one memory. The at least one processor can be configured to perform a method including methods described above.

According to yet another embodiment of the present disclosure, a computer readable storage medium comprises computer instructions which, responsive to being executed by one or more processors, cause the one or more processors to perform operations as described in the methods or systems above or elsewhere herein.

As shown in FIG. 10, an information processing system 101 of a system 200 can be communicatively coupled with the data processing module 150 and a group of client or other devices, or coupled to a presentation device for display at any location at a terminal or server location. According to this example, at least one processor 102, responsive to executing instructions 107, performs operations to communicate with the processing module 150 via a bus architecture 208, as shown. The at least one processor 102 is communicatively coupled with main memory 104, persistent memory 106, and a computer readable medium 120. The processor 102 is communicatively coupled with an Analysis & Data Storage 115 that, according to various implementations, can maintain stored information used by, for example, the data processing module 150 and more generally used by the information processing system 200. The data processing module 150 can be coupled to one or more sensors 152 as needed. Such sensors can be barcode scanners, fingerprint readers, proximity sensors, microphones, cameras, video cameras, location sensors, motion detectors, scales, biometric reading devices (e.g., iris scanners, facial recognition scanners, voice detection devices) and other devices as contemplated herein. Optionally, this stored information can be received from the client or other devices. For example, this stored information can be received periodically from the client devices and updated or processed over time in the Analysis & Data Storage 115. Additionally, according to another example, a history log can be maintained or stored in the Analysis & Data Storage 115 of the information processed over time. The data processing module 150, and the information processing system 200, can use the information from the history log such as in the analysis process and in making decisions related to a particular user's access or for logging electronically tagged objects according to a database of best practices for a particular procedure or procedures.

The computer readable medium 120, according to the present example, can be communicatively coupled with a reader/writer device (not shown) that is communicatively coupled via the bus architecture 208 with the at least one processor 102. The instructions 107, which can include instructions, configuration parameters, and data, may be stored in the computer readable medium 120, the main memory 104, the persistent memory 106, and in the processor's internal memory such as cache memory and registers, as shown.

The information processing system 200 includes a user interface (or interfaces) 110 that comprises a user output interface 112 and user input interface 114. Examples of elements of the user output interface 112 can include a display, a speaker, one or more indicator lights, one or more transducers that generate audible indicators, and a haptic signal generator or any of the interfaces illustrated or discussed with respect to the figures or elsewhere in the application. Examples of elements of the user input interface 114 can include a keyboard, a keypad, a mouse, a track pad, a touch screen, a touch pad, a microphone that receives audio signals, a camera, a video camera, a CT-Scanner, or any other scanner that scans images. Some user inputs can be sensors or vice-versa. The received audio signals or scanned images, for example, can be converted to electronic digital representations and stored in memory, and optionally can be used with corresponding voice or image recognition software executed by the processor 102 to receive user input data and commands, or to receive test data for example. The voice recognition software can be used to enter or check off items on a checklist and further provide data or text entry allowing the practitioner to enter notes as needed.

A network interface device 116 is communicatively coupled with the at least one processor 102 and provides a communication interface for the information processing system 100 to communicate via one or more networks 108. The networks 108 can include wired and wireless networks, and can be any of local area networks, wide area networks, or a combination of such networks. For example, wide area networks including the internet and the web can intercommunicate the information processing system 100 with other one or more information processing systems that may be locally, or remotely, located relative to the information processing system 100. It should be noted that mobile communications devices, such as mobile phones, Smart phones, tablet computers, lap top computers, and the like, which are capable of at least one of wired and/or wireless communication, are also examples of information processing systems within the scope of the present disclosure. The network interface device 116 can provide a communication interface for the information processing system 100 to access the at least one database 117 according to various embodiments of the disclosure.

The instructions 107, according to the present example, can include instructions for monitoring, instructions for analyzing, instructions for retrieving and sending information and related configuration parameters and data. It should be noted that any portion of the instructions 107 can be stored in a centralized information processing system or can be stored in a distributed information processing system, i.e., with portions of the system distributed and communicatively coupled together over one or more communication links or networks.

FIGS. 1-9 illustrate examples of systems, methods or process flows, according to various embodiments of the present disclosure, which can operate in conjunction with the information processing system 200 of FIG. 10.

The invention claimed is:

1. A harness belt system for assisting in the performance of sit-up exercises, comprises:

at least one horizontally oriented belt member;

an adjustable belt clip or a hook and loop fastener on at least one of two opposing ends of the at least one horizontally oriented belt member;

a substantially V-shaped tether having at least two top ends coupled to separate portions of the at least one horizontally oriented belt member and a bottom end; and wherein the harness belt system is configured when in use to have the bottom end of the substantially V-shaped tether tethered to a stationary object to have the at least one belt member in a closed position for placement of the at least one belt member on bent legs over a front of a user's thigh or behind the user's thigh or on a user's calves to use in the performance of the sit-up exercises.

2. The harness belt system of claim 1, wherein the adjustable belt clip comprises a quick release buckle.

3. The harness belt system of claim 1, wherein the system further comprises a carabiner attached at the bottom end of the substantially V-shaped tether.

4. The harness belt system of claim 1, wherein the horizontally oriented belt member and the substantially V-shaped tether are integrated and formed from a single piece of material.

5. The harness belt system of claim 1, wherein each of the top ends of the substantially V-shaped tether couples to the belt member at an angle ranging from 22 degrees to 89 degrees.

6. The harness belt system of claim 1, wherein the substantially V-shaped tether is coupled to the belt member by sewing the top ends of the tether to separate portions of the horizontally oriented belt member.

7. The harness belt system of claim 1, wherein the substantially V-shaped tether is coupled to the horizontally oriented belt member by riveting the top ends of the tether to separate portions of the horizontally oriented belt member.

8. The harness belt system of claim 1, wherein the at least one belt member comprise a first belt arranged and configured for strapping around a left leg and a second belt arranged and configured for strapping around a right leg.

9. The harness belt system of claim 1, wherein the substantially V-shaped tether is coupled to the horizontally oriented belt member by looping the top ends of the tether onto separate portions of the horizontally oriented belt member or hooking the top ends of the tether onto separate portions of the horizontally oriented belt member or by braiding the top ends of the tether into separate portions of the horizontally oriented belt member.

10. The harness belt system of claim 1, wherein the substantially V-shaped tether is coupled to the horizontally oriented belt member by using rings.

11. The harness belt system of claim 1, wherein the horizontally oriented belt member is made of materials selected from plastic, vinyl, metal, leather, webbing, cloth, or any combination thereof.

12. The harness belt system of 1, wherein the system further comprises an extension to the tether made from the same material as the horizontally oriented belt member.

13. The harness belt system of claim 1, wherein the substantially V-shaped tether comprises a single strap that is looped at a mid-point of the single strap to form a loop at the bottom end of the V-shaped tether.

14. The harness belt system of claim 1, wherein the system further comprises a sensor embedded in the belt or tether where the sensor detects instances of a motion characteristic of a sit-up and transmits information regarding the instances to a wireless receiving device.

15. A harness belt system for assisting in the performance of sit-up exercises, comprises:

at least one horizontally oriented belt member;

an adjustable belt clip on at least one of two opposing ends of the at least one horizontally oriented belt member;

a substantially V-shaped tether having at least a top portion coupled to the at least one horizontally oriented belt member and a bottom end; and wherein a top end of the substantially V-shaped tether couples to the at least one horizontally oriented belt member and forms at least an angle with the at least one belt member ranging from 91 degrees to 158 degrees.

16. The harness belt system of claim 15, wherein the system is configured when in use to have the bottom end of the substantially V-shaped tether tethered to a stationary object to have the at least one horizontally oriented belt member in a closed position for placement of the adjustable belt clip and belt on bent legs over a front of a user's thigh or behind the user's thigh or on a user's calves.

17. The harness belt system of claim 15, wherein the V-shaped tether couples to the at least one horizontally oriented belt member and forms at least an angle with the belt member ranging from 91 degrees to 120 degrees.

18. The harness belt system of claim 15, wherein the at least one horizontally oriented belt member and the substantially V-shaped tether are integrated and formed from a single piece of material.

19. The harness belt system of claim 15, wherein the at least one horizontally oriented belt member comprise a first belt arranged and configured for strapping around a left leg and a second belt arranged and configured for strapping around a right leg.

20. A harness belt system for assisting in the performance of sit-ups, comprises:

a horizontally oriented belt member;

a size adjustable belt clip on at least one of two opposing ends of the horizontally oriented belt member that allows for adjustments in the length of the belt member;

a substantially V-shaped or inverted triangular shaped tether having at least a top portion attached to the horizontally oriented belt member and a bottom end; and wherein a top end of the tether attaches to the belt member and forms at least an angle with the belt member ranging from 91 degrees to 158 degrees.

* * * * *